US006360171B1

(12) United States Patent
Miyamoto et al.

(10) Patent No.: US 6,360,171 B1
(45) Date of Patent: Mar. 19, 2002

(54) BUMPING PREVENTION SYSTEM

(75) Inventors: Kazumasa Miyamoto; Naoya Noguchi; Satoshi Moteki; Harutada Ooya, all of Tokyo; Hideaki Murakami, Kyoto; Masaya Yamada, Osaka; Hiroshi Takahashi, Yokohama; Akihiko Takiguchi; Koji Kubota, both of Tokyo; Akira Kuno, Kariya; Hisashi Ezure, Kawasaki; Tetsuaki Kondo; Ryoji Matsubara, both of Tokyo; Yasuyuki Ohira, Kawasaki; Kenichi Ohtani; Hiroshi Mashimo, both of Tokyo; Takao Inobe, Kadoma; Kazutaka Kawahara, Tokyo, all of (JP)

(73) Assignee: Public Works Research Institute, Ministry of Construction (JP)

( * ) Notice: Subject to any disclaimer, the term of this patent is extended or adjusted under 35 U.S.C. 154(b) by 0 days.

(21) Appl. No.: 09/693,263

(22) Filed: Oct. 20, 2000

(30) Foreign Application Priority Data

Oct. 27, 1999 (JP) ..... 11-305095
Oct. 27, 1999 (JP) ..... 11-305103

(51) Int. Cl.[7] ..... G08G 1/00

(52) U.S. Cl. ..... 701/301; 701/36; 340/436; 340/903; 340/425.5; 180/168

(58) Field of Search ..... 701/301, 36, 200; 340/436, 435, 425.5, 903; 180/168, 169

(56) References Cited

U.S. PATENT DOCUMENTS 5,835,028 A * 11/1998 Bender et al. ..... 340/937
5,890,083 A * 3/1999 Franke et al. ..... 701/45
6,151,539 A * 11/2000 Bergholz et al. ..... 701/25
6,215,392 B1 * 4/2001 Okada ..... 340/436
6,223,125 B1 * 4/2001 Hall ..... 701/301

* cited by examiner

*Primary Examiner*—William A. Cuchlinski, Jr.
*Assistant Examiner*—Olga Hernandez
(74) *Attorney, Agent, or Firm*—Fulbright & Jaworski L.L.P.

(57) ABSTRACT

A system-enabled vehicle entering a crossing warns a driver of the vehicle that a possibility of bumping exists, thereby allowing the driver to brake and stop the vehicle in an emergency in front of the crossing. When the system determines a possibility of bumping with another vehicle entering the crossing exists, the system continuously provides controls for decelerating and stopping the vehicle in a range from a point where the system can decelerate the vehicle in an emergency with time allowance for stopping the vehicle in front of the crossing up to a point in front of the crossing.

5 Claims, 6 Drawing Sheets

BUMPING PREVENTION SYSTEM

FIELD OF THE INVENTION

The present invention relates to an bumping prevention system which is used, for instance, in the field of traffic signal control and prevents bumping between a vehicle running in a non-priority road and a vehicle running in a priority road at a crossing between the two roads by transacting signals with on-road infrastructure in a service area between fixed point information detection support facility for service-in installed at a point by a specified distance away from the crossing on the non-priority road and a fixed point information detection support facility for service-out installed at a point near the crossing.

BACKGROUND OF THE INVENTION

Conventionally, in order to prevent bumping at a crossing between a priority road and a non-priority road as described above, a driver just about to enter from a non-priority road into a priority road once stops in front of the crossing, checks behaviors of vehicles running on the priority road with a mirror installed at the crossing, and then restarts after the safety is confirmed.

Therefore, it is impossible to completely prevent bumping due to a driver's careless mistake or the driver's mistake in determination of the situation, and occurrence of traffic accidents between a vehicle running on a priority road and that running on a non-priority road has not completely been suppressed.

OBJECTS AND SUMMARY OF THE INVENTION

It is an object of the present invention to provide an expected bumping prevention system which can solve the problems in the conventional technology as described above and prevent bumping between vehicles by supporting safe access of a vehicle running on a non-priority road to a crossing between the non-priority road and a priority road, and/or supporting restart of a vehicle at a stop in front of the crossing.

To achieve the object described above, the bumping prevention system according to the present invention is a system for preventing bumping between a vehicle running on a non-priority road and a vehicle running on a priority road at a crossing between the two roads by transacting signals with on-road infrastructure in a service area between a fixed point information detection support facility for service-in installed at a point away by a specified distance from the crossing on the non-priority road and a fixed point information detection support facility for service-out installed at a position near the crossing, and when a vehicle passes by the fixed point detection support facility for service-in and enters the service area, the vehicle recognizes availability of providing information, alarms, and control for prevention of expected bumping at a crossing upon reception of a signal indicating entry into a service area from the support facilities, and starts computing of a position of the current by recognizing a distance between the current running position of the vehicle and a priority road. When the vehicle receives information concerning vehicles on a priority road from the on-road infrastructure and recognized that a vehicle just about to enter the crossing is present on the priority road, the system provides information concerning the crossing as well as the vehicle just about to enter the crossing at a point away by a distance enough to decelerate and stop the vehicle by the crossing, and further when it is determined that there is the possibility of collision between the vehicle running on the non-priority road and the vehicle running on the priority road and just about to enter the crossing, the system gives an alarm indicating the possibility of bumping to a driver of the vehicle running on the non-priority road. Further when it is expected that there is the possibility of bumping between the vehicle and another vehicle running on the priority road and entering the crossing, the system continuously provides controls for emergently decelerating or stopping the vehicle in front of the crossing.

In the system described above, it is preferable to provide information with a time allowance sufficient for a vehicle's driver to understand contents of the information and also required for braking the vehicle in an emergency, to give an alarm to the driver with a time allowance sufficient for the vehicle's driver to respond to the driver and also enough for the driver to brake the vehicle, and also to provide automatic controls for decelerating or stopping the vehicle taking into account a delay time in this control system and a rising time for braking.

Further to achieve the object described above, the bumping prevention system according to the present invention is a system for preventing bumping between a vehicle running on a non-priority road and a vehicle running on a priority road at a crossing between the two roads by transacting signals with on-road infrastructure in a service area between a fixed point information detection support facility for service-in installed at a point away by a specified distance from the crossing on the non-priority road and a fixed point information detection support facility for service-out installed at a position near the crossing, and when a vehicle passes by the fixed point information detection facility for service-in and enters the service area, the vehicle receives a signal indicating start of the service area from the support facility and recognizes the availability of information provision service for preventing expected bumping after restart. When the vehicle stops in front of the crossing, the vehicle obtains information concerning vehicles on a priority road from the on-road infrastructure and if the vehicle recognizes presence of a pedestrian or a vehicle just about to enter the crossing on a priority road, information indicating presence of the pedestrian or vehicle is given to the driver.

Further to achieve the object described above, the bumping prevention system according to the present invention is a system for preventing bumping between a vehicle running on a non-priority road and a vehicle running on a priority road at a crossing between the two roads by transacting signals with on-road infrastructure in a service area between a fixed point information detection support facility for service-in installed at a point away by a specified distance from the crossing on the non-priority road and a fixed point information detection support facility for service-out installed at a position near the crossing, and when a vehicle passes by a fixed point information detection support facility for service-in and enters a service area, the vehicle recognizes availability of the service for providing information, alarms, and controls for prevention of bumping when the vehicle accesses a crossing or availability of the information provision service for prevention of expected bumping after the vehicle once stops in front of the crossing and then restarts upon reception of a signal indicating start of the service area from the support facilities, and starts computing a position of the vehicle by grasping the distance from the running position of the vehicle up to the priority road. When the vehicle obtains information concerning vehicles on the priority road from the on-road infrastructure and recognizes that a vehicle just about to enter the crossing is present on the priority road, the system provides information concerning the crossing as well as presence of the vehicle just entering the crossing on the priority road to the driver at a point where the driver can decelerate and stop the vehicle in front of the crossing. Further when it is determined that there is the possibility of bumping with the vehicle just entering the crossing, this system gives an alarm indicating the possibility of bumping to the driver at a point where the driver can brake and stop the vehicle in an emergency in front of the crossing. Still further when it is determined that there is the possibility of bumping with another vehicle subsequently entering the crossing, the system continuously provides controls for support in braking in a range from a point where the driver can brake and stop the vehicle in front of the crossing up to a point just in front of the crossing. When the vehicle stops the vehicle once in front of the crossing, the system obtained information concerning vehicles on the priority road and gives to the driver information concerning the vehicle, if any.

In the system described above, it is preferable to provide information with a time allowance sufficient for a vehicle's driver to understand contents of the information and also required for braking the vehicle in an emergency, to give an alarm to the driver with a time allowance sufficient for the vehicle's driver to respond to the alarm and also enough for the driver to brake the vehicle, and also to provide automatic controls for decelerating or stopping the vehicle taking into account a delay time in this control system and a rising time for braking.

With the configuration as described above, it is possible to prevent bumping between vehicles by supporting safe access of a vehicle running on a non-priority road to a crossing between the non-priority road and a priority road, and/or supporting restart of the vehicle after the vehicle stops once in front of the crossing. Therefore it is possible to substantially reduce the possibility of bumping between a vehicle running on a priority road and that running on a non-priority road at a crossing between the two roads, thus safety at the crossing being substantially improved.

DETAILED DESCRIPTION OF THE PREFERRED EMBODIMENTS

Figure 1:
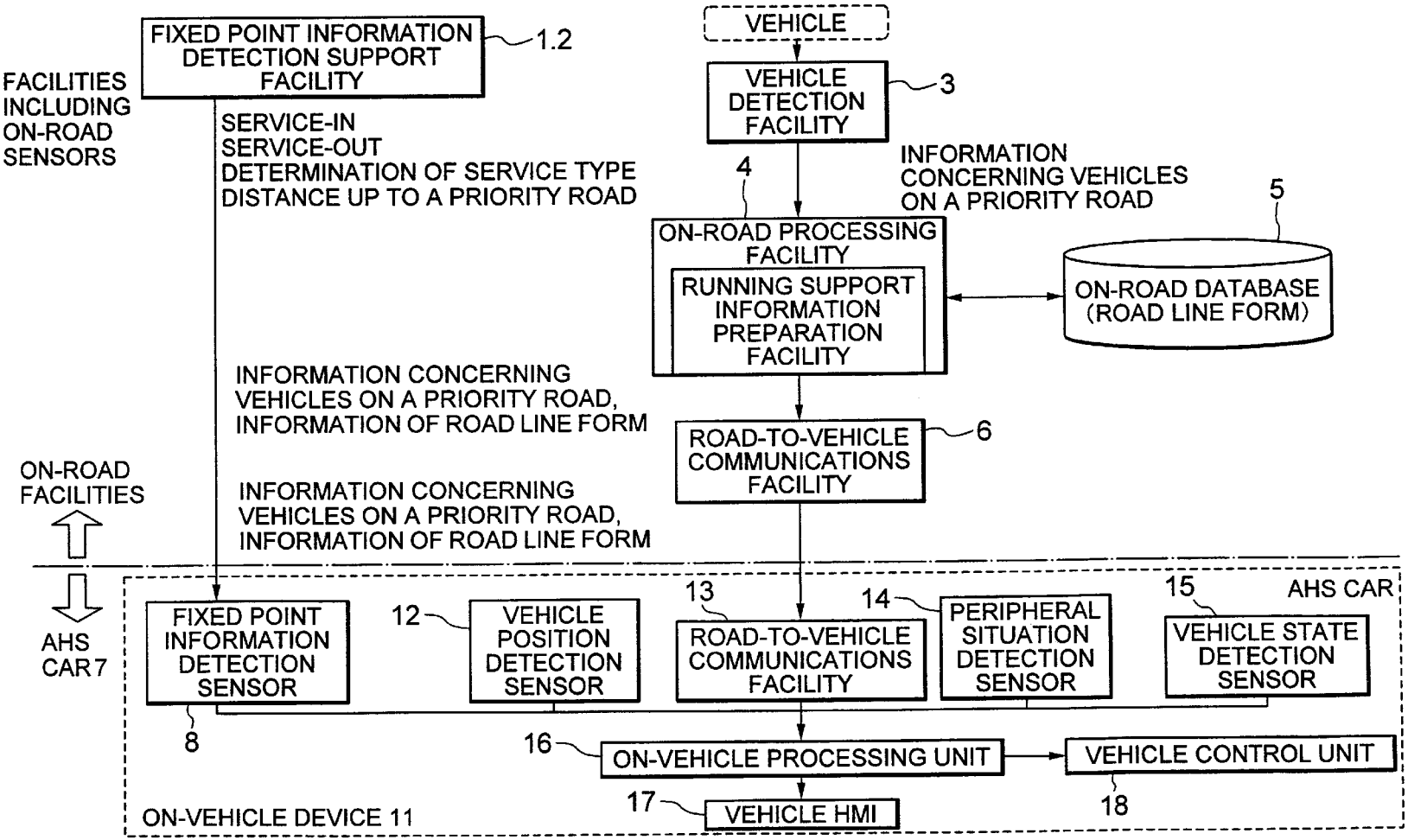
FIG. 1 is a general block diagram showing an bumping between vehicles according to one embodiment of the present invention.

FIG. 1 is a block diagram showing general configuration of this system, and in the system shown in the figure, the number of each facility may vary according to a point where the facility is installed or a monitoring range for the on-road facility, but a number of facility is not an important factor. Also the input/output data in this figure indicates only those essentially required in this system.

At first functional contents of on-road facility as the on-road infrastructure constituting this system as well as of facilities loaded on an AHS car as an example of vehicle are described. Herein the term of AHS is an abbreviation of Automated Highway System indicating a road system enabling automatic driving of vehicles, and the AHS car indicates a car which can automatically be controlled by the Automated Highway System. The on-road facilities of this system comprises fixed point information detection support facilities 1, 2 provided on a non-priority road, and a vehicle detection facility 3, an on-road processing facility 4, an on-road database 6, and a road-to-vehicle communications facility 6 each provided on a priority road, and functions of each facility are as described below. Namely the fixed point information detection support facilities 1, 2 are facilities used in a pair with a fixed point information detection sensor 8 loaded on the AHS car 7, and the AHS car 7 having passed the fixed point information detection support facility 1 installed at a specified position on the road can recognize a service-in point, a type of the provided service, and a service-out point. The vehicle detection facility 3 detects behaviors (such as a position and a velocity) of vehicles including two-wheel vehicles) running on a priority road. The on-road processing facility (including the running support information preparation facility) 4 is a computing/processing unit as a main device among the on-road facilities for this service, and the facility 4 executes operations mainly for processing input/output data and preparing output data. The on-road database 5 is a database in which data required for the service is stored, and in this system information concerning road line form of objective priority roads and non-priority roads. The system provides the information when accessed by the on-road processing facility 4. The road-to-vehicle communications facility 6 executes communications between the on-road facilities and a vehicle, and in this system the road-to-vehicle communications facility 6 provides mainly information concerning vehicles on a priority road and information concerning road line form to the AHS car 7.

Devices 11 loaded on the AHS car 7 includes a fixed point information detection sensor 8, an AHS car position detection sensor 12, a road-to-vehicle communications device 13, a peripheral situation detection sensor 14, an AHS car state detection sensor 15, and an on-vehicle processing unit 16, and functions of each device is as described below. Namely the fixed point information detection sensor is a facility used as a pair with the fixed point information detection support facility 1, and detects such factors as a type of available service, a service area length, and service-out or the like when the vehicle passes by the fixed point information support facility 1 installed at a specified position on the road. The AHS car position detection sensor 12 detects a position of the AHS car based on the information from the fixed point information detection support facility 1. The road-to-vehicle communications device 13 controls communications between on-road facilities and vehicles. The peripheral situation detection sensor 14 detects a situation around the AHS car. The AHS car state detection sensor 15 detects a velocity, acceleration or the like of the AHS car. The on-vehicle processing device (including also the computing/processing unit) 16 is a device which collects information required for the AHS car and executes processing such as provision of information, computing, and determination, and in this system the on-vehicle processing device 16 provides information concerning presence of a vehicle entering a crossing, determines the possibility of bumping, and gives an instruction for alarm to the on-vehicle HMI (Human Machine Interface) 17 and a control instruction value to the vehicle control unit 18 when it is determined that there is the possibility of bumping.

Figure 2:
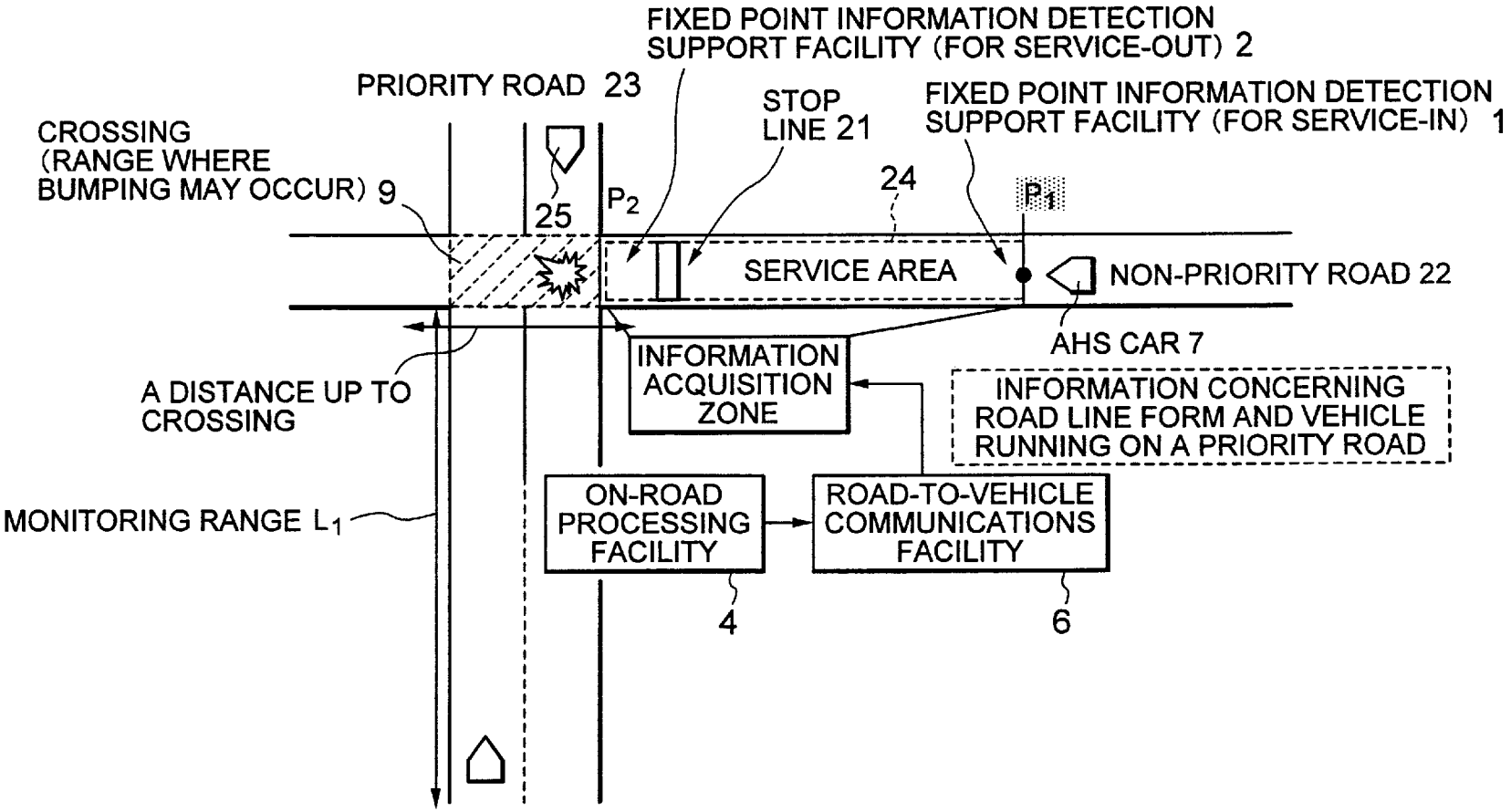
FIG. 2 is an on-road section of this system for describing a scenario according to the present invention.

This service assumes a section of an ordinary road where there is not sign for a crossing. An example of the service is described below with reference to FIG. 2. FIG. 2 shows a crossing 9 (without any alarm) between a non-priority road 22 with a stop line 21 provided thereon and a priority road 23, and this figure shows an example in which a priority road with two lanes to which the present invention is applied and a non-priority road with one lane.

Herein description is made for a system in which information, alarms, and controls are provided when the AHS car is approaching a crossing 9 within a service area 24 including a stop line 21 and it is determined that there is the possibility of collision of the vehicle with another vehicle running on a priority road 23 and also for a system in which information is provided when the vehicle stops once at a stop line and then restarts assuming a vehicle approaching the crossing and following the operating sequence up to the processing sequence.

FIG. 2 assumes that the fixed point information detection support facility 1 for service-in installed at a point $P_1$ away by a specified point (for instance, 40 m) from the crossing 9 can recognize a service-in point, a service-out point, an area length, and a type of available service. When the AHS car 7 passes by the point $P_1$, and enters the service area 24, the AHS car recognizes availability of the service for providing information, alarms, and controls for prevention of bumping during access to the crossing 9, grasps a running position of the AHS car and a distance up to a priority road, and starts computing for a position of the AHS car. The AHS car 7 having reached the point $P_1$ activates the service for providing information, alarms, and controls for prevention of bumping and immediately start acquisition of the information concerning vehicles running on the priority road 23 from the on-road infrastructure. The information concerning vehicles on the priority road 23 is transmitted at a prespecified cycle (typically at a cycle of 0.1 second) through the road-to-vehicle communications facility 6. When the AHS car 7 in the service area 24 continues to run and passes through the crossing 9, the AHS car 7 determines whether there is the possibility of collision of the AHS car with another vehicle 25 running on the priority road 23.

FIG. 2 shows an example of determination on the possibility of collision of the AHS car with the vehicle 25 from the upstream side of the priority road 23 at the crossing 9. In this case, it is required only to check how the time zone in which the vehicle approaching the crossing 9 from the upstream side of the priority road 23 resides on the crossing overlaps with the time zone in which the AHS car 7 resides within the crossing 9. Namely, if the two time zones overlaps with each other, it is determined that there is the possibility of collision, and if the two time zones do not overlap with each other, it is determined that there is not the possibility of collision. The AHS car 7 can determine the possibility of collision by assuming a constant acceleration pattern (including a uniform velocity movement) and also assuming that the vehicle 25 approaching from the upstream side of the priority road 23 to the crossing continues to run at the current velocity measured at the current point detected by the vehicle detection facility 3. When it is determined that there is the possibility of collision, an alarm is generated, and at the same time controls are provided to control running of the vehicle with the vehicle control unit 18. After the vehicle stops at a stop line 21 once, the AHS car receives information concerning vehicles just about to enter the crossing. The fixed point information detection support facility 2 installed at the point $P_2$ is for enabling detection of service out, and provision of the service is finished when the AHS car 7 has passed over this point.

Figure 3:
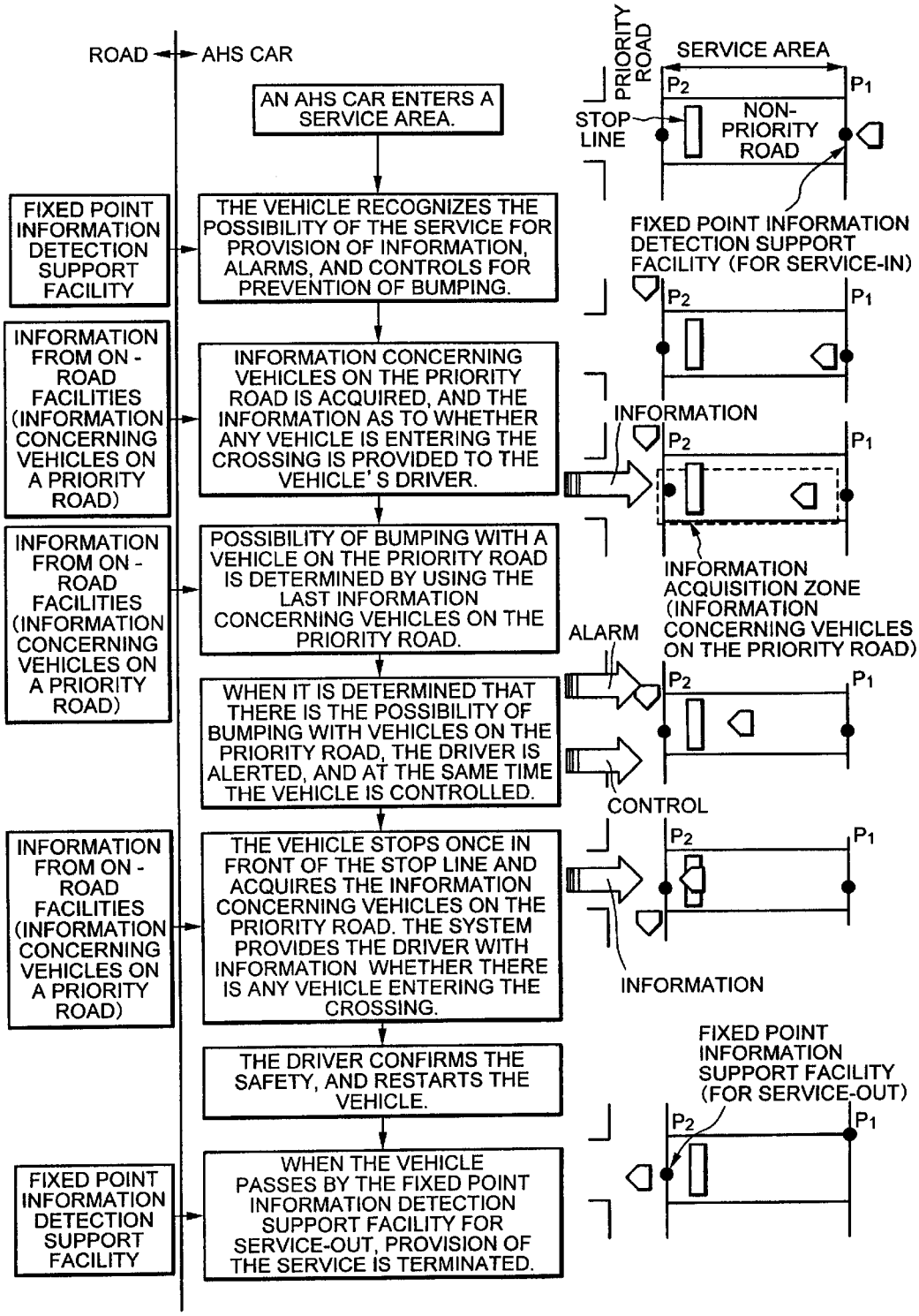
FIG. 3 is a scenario in this system.

FIG. 3 is an explanatory view showing a scenario in this bumping prevention system, and is a flow chart showing the operations described above.

Figure 4:
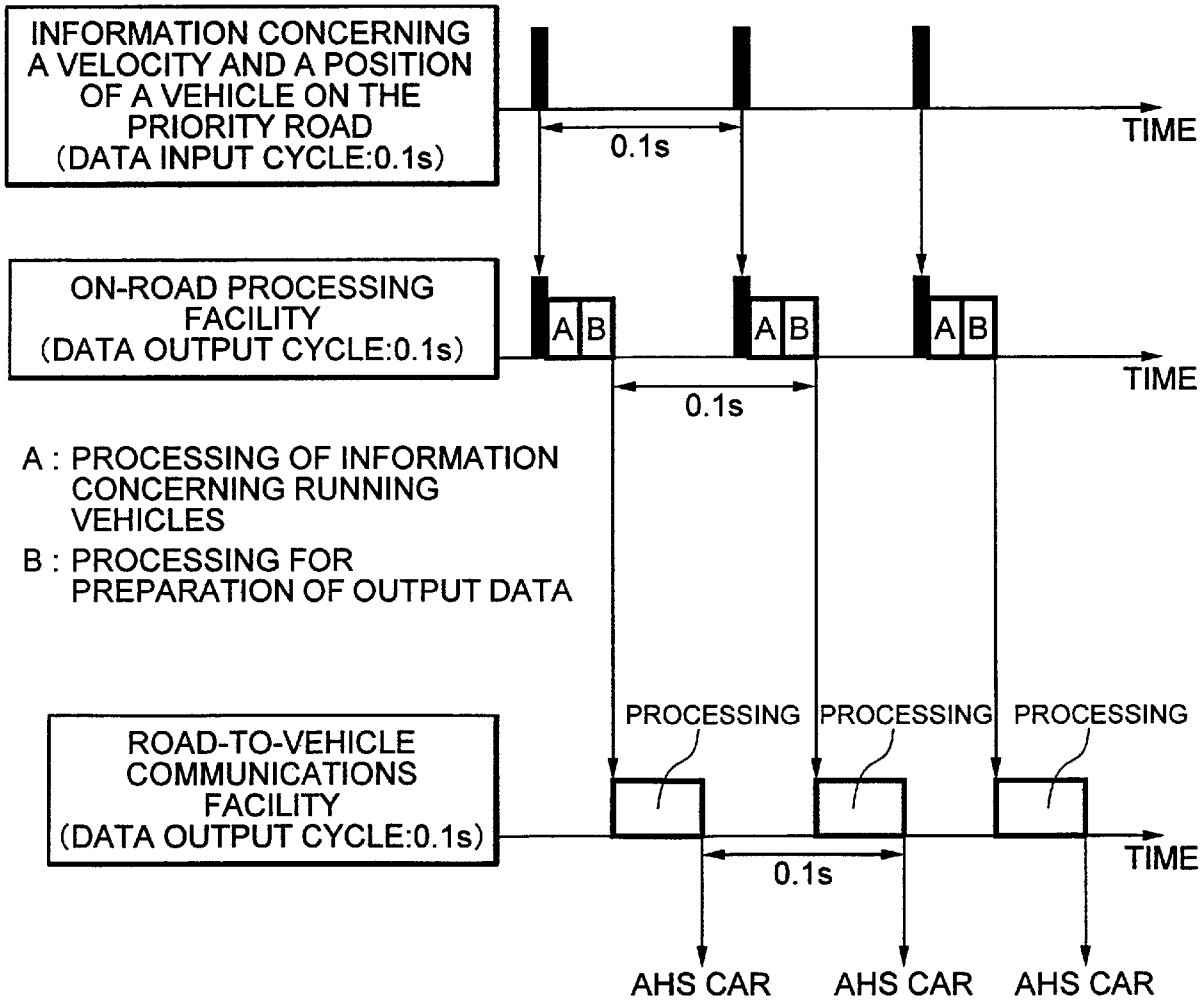
FIG. 4 is a time chart for processing by the on-road facilities in this system.

FIG. 4 is a time chart for the bumping prevention system centering on the on-road processing facility 4 at the crossing shown in FIG. 2. AS shown in FIG. 4, input to the on-road processing facility in this system is information concerning a velocity and a position of a vehicle on the priority road 23. Information concerning vehicles on the priority road 23 is inputted once for every 0.1 second from the vehicle detection facility 3, and is stored in the on-road database 5. The on-road processing facility 4 prepares information to be transmitted to the AHS vehicle 7 once for every 0.1 second.

Figure 5:
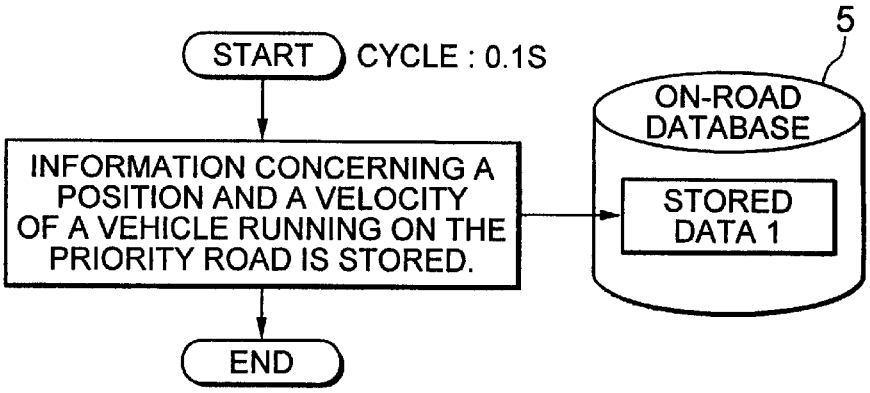
FIG. 5 is a flow 1 of the processing by the on-road processing facility.
Figure 6:
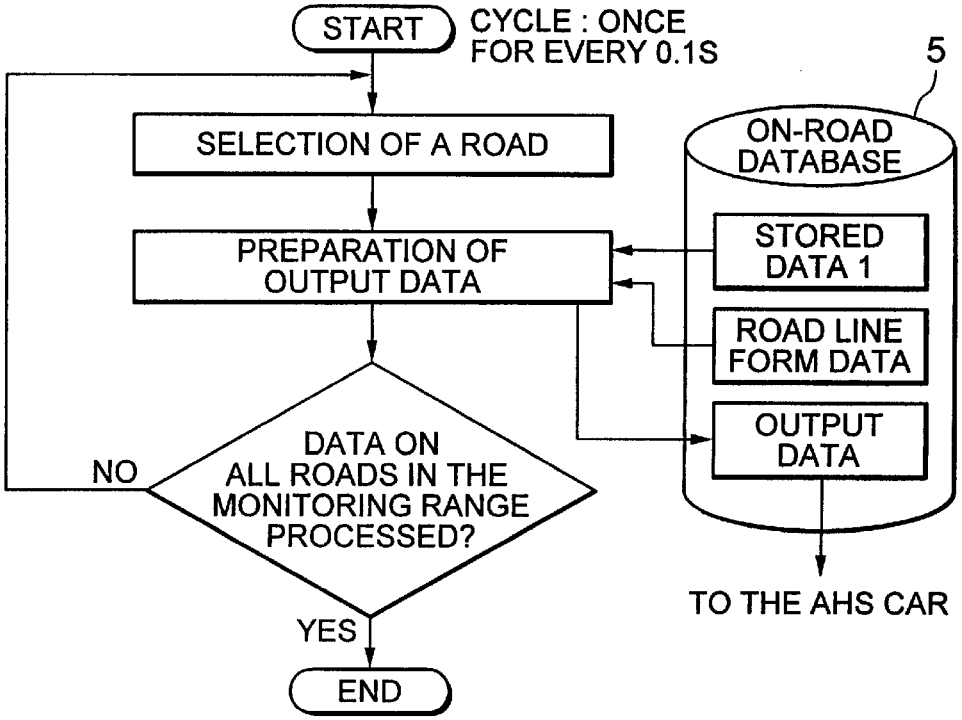
FIG. 6 is a flow 2 of the processing by the on-road processing facilities.

FIG. 5 and FIG. 6 show processing flows by the on-road processing facility 4 at the crossing shown in FIG. 2. FIG. 5 shows a flow of processing a data concerning a position and a velocity of the vehicle 25 on the priority road 23 detected by the vehicle detection facility 3. The processing is executed once for every 0.1 second, and the data is stored as data 1 indicating a position and a velocity of the detected vehicle and a time of detection of the data in the on-road database 5. FIG. 6 shows a processing flow for preparation of output data to be sent to the ASH car 7. This processing is executed once for every 0.1 second, and the prepared output data is once stored in the on-road database 5. The stored output data is transmitted from the road-to-vehicle communications facility 6 to the AHS car 7. The information concerning a velocity and a position of the vehicle 25 on the priority road 23 detected by the vehicle detection facility 3 is used for determination of the possibility of bumping.

Figure 7:
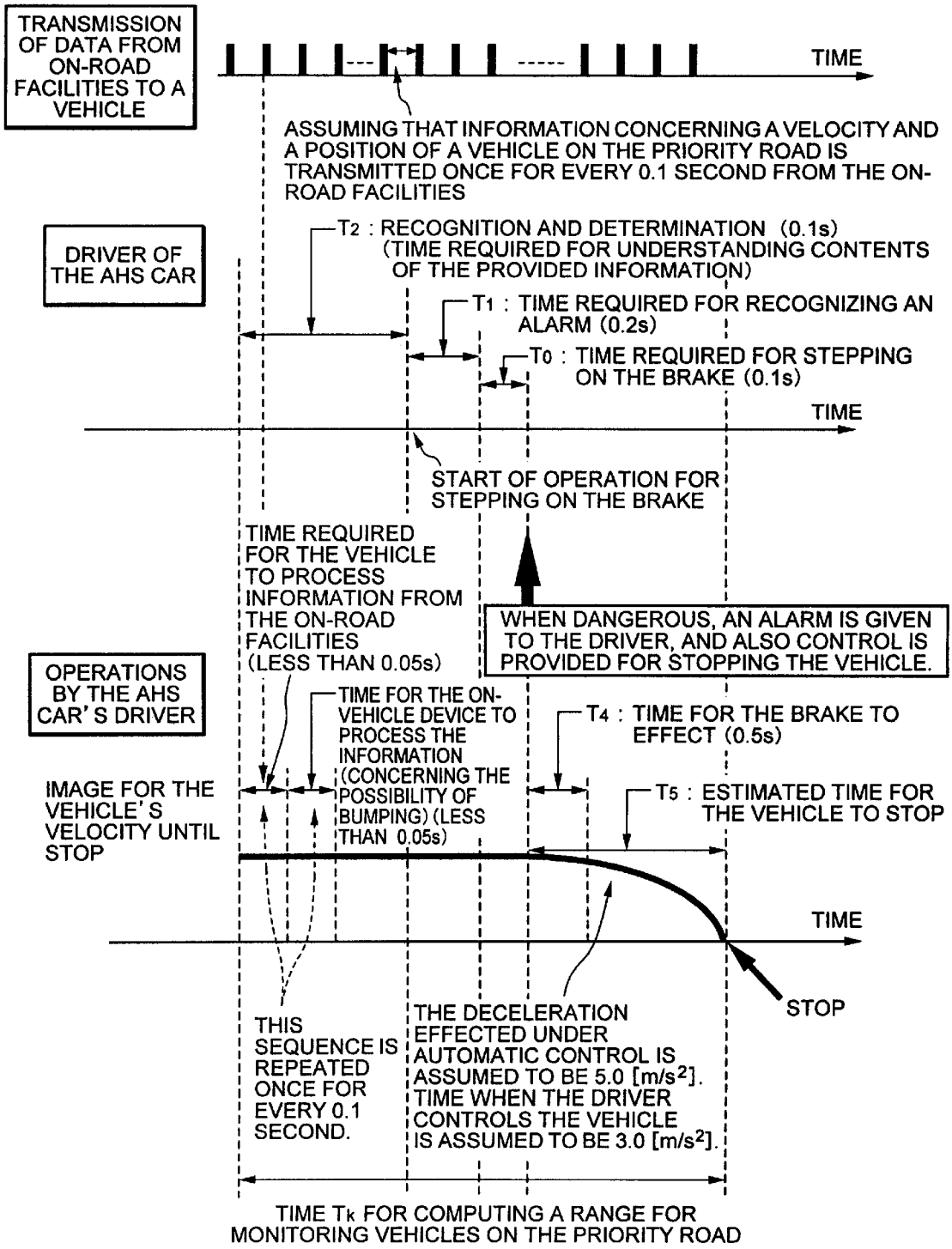
FIG. 7 is a time chart centering on an AHS car according to this system.

FIG. 7 is a time chart of the processing for computing a range of management by the on-road facility on the bumping prevention system shown in FIG. 2, and mainly shows the AHS car and the driver's operations. The bumping prevention system has the vehicle detection facility 3 installed on the priority road 23 and the fixed information detection support facilities 1, 2 installed on a non-priority road.

The bumping prevention system mainly computes a range of monitoring by the vehicle detection facility 3 for monitoring the vehicle 25 running on the priority road 23 toward the crossing 9 and a range of communications for a vehicle to be serviced.

At first, the total time $T_k$ from a point of time when a driver of the AHS car 7 running on a non-priority road 22 recognizes presence of a vehicle 25 entering a crossing on the priority road and brakes the AHS car 7 until the point of time when the AHS car 7 stops in front of the stop line is computed. A distance $L_1$ between the crossing 9 and the vehicle at the distal point can be obtained by multiplying the total time $T_k$ by the maximum velocity V of the vehicle 25.

As shown in FIG. 7, the time $T_3$ from the point of time when the driver recognizes presence of a vehicle accessing the crossing on the priority road and determines the possibility of bumping until the point of time when the driver actually brakes the vehicle is computed through the equation 1:

$$T_3=T_2+T_1+T_0 \quad (1)$$

wherein $T_2$ is a period of time from the point when the driver recognizes a situation on the priority road 23 until a point of time when the driver determines the possibility of bumping, $T_1$ is a period of time required for changing a foot position from the accelerator to the brake, and $T_0$ is a period of time required for actually stepping on the accelerator. Assuming that a running speed of the AHS car 7 is reduced to a velocity a in the time $T_4$ after the driver brakes the AHS car 7, a period of time $T_5$ from a point of time when the driver brakes until the AHS car 7 actually stops in front of the crossing 9 can be computed through the equation 2:

$$T_5 = \frac{V}{a} + \frac{T_4}{2} \tag{2}$$

The distance over which the AHS car 7 runs from the point of time when the driver receives the information until the point of time when the ASH car 7 actually stops at the stop line 21 is computed through the equation 3:

$$L = V \times T_3 + V \times T_4 - \frac{1}{6} \times a \times T_4^2 + \frac{1}{2a}\left(V - \frac{1}{2}a \times T_4\right)^2 \tag{3}$$

Therefore, assuming the equation 4:

$$T_k = T_3 + T_5, \tag{4}$$

and the equation 5:

$$L_1 = V \times T_k \tag{5}$$

wherein $T_2$=1.0s, $T_1$=0.2s, $T_0$=0.1s, $T_4$=0.5s, a=3.0 [m/s$^2$], and V=60 [km/h], $L_1 = V \times T_k$=60 [Km/h]×(1.3[s]+5.8[s])=118.7 [m], so that the distance $L_1$ is equal to 119 [m] when the decimal section is rounded up.

From the result of calculation above, it is assumed that a range of monitoring by the vehicle 25 is 119 m from the crossing 9.

Further as the distance L is equal to 32.6 m, it is assumed the range of communications is 40 m when the first digit is rounded up.

Description of the embodiment above assumes that support for access to a crossing and support for a restarting vehicle are combined with each other in this system, but it is needless to say that either one may be provided as an independent service. Further the description above assumed that there is no alarm at the crossing point, but this system can be applied even to a crossing with a flickering alarm. In addition, arrangement of a priority road and a non-priority road in this system such as a number of lanes, a width of each lane, and a number of various types of facilities to be provided on the road are arbitrary, and the present invention is not limited to the configuration shown in the figures.

What is claimed is:

1. A bumping prevention system for preventing bumping between a vehicle running on a non-priority road and another vehicle running on a priority road at a crossing between the two roads by transacting signals with on-road infrastructure in a service area from a fixed point information detection support facility for service-in installed at a point away by a specified distance from the crossing up to a fixed point information detection support facility for service-out installed at a point near the crossing, wherein, when a vehicle passes by the fixed point information detection support facility for service-in and enters the service area, a driver of the vehicle receives a signal indicating start of the service area from the support facility and recognizes availability of the services for provision of information, alarms, and controls for prevention of bumping when approaching the crossing, said system starts computing a position of the vehicle by grasping a distance from a current position of the vehicle up to the priority road, acquires information on vehicles on the priority road from the on-road infrastructure, provides information the vehicle's driver with information concerning presence of the crossing as well as of vehicles entering the crossing at a point where the driver can brake the vehicle with sufficient time allowance for stopping the vehicle in front of the crossing when there is any vehicle entering the crossing on the priority road, gives an alarm alerting the possibility of bumping at a position where the driver can brake the vehicle in an emergency with sufficient time allowance for stopping the vehicle in front of the crossing when it is determined that there is the possibility of bumping with a vehicle entering the crossing, and continuously provides controls for support for braking in a range from the position where the driver can brake the vehicle in an emergency with sufficient time allowance for stopping the vehicle in front of the crossing up to a position in front of the crossing.

2. The bumping prevention system according to claim 1, wherein said system provides a driver of a vehicle with information taking into a period of time in which the driver responds to the information as well as a period of time in which a braking operation is actually effected, gives an alarm to the driver taking into account a period of time in which the driver responds to the alarm and the driver's braking operating is actually effected, and also provides automatic control for stopping the vehicle taking into account a delay time of this control system and a period of time required until braking is actually effected in the emergent stop.

3. A bumping prevention system for preventing bumping between a vehicle running on a non-priority road and another vehicle running on a priority road at a crossing between the two roads by transacting signals with on-road infrastructure in a service area from a fixed point information detection support facility for service-in installed at a point away by a specified distance from the crossing up to a fixed point information detection support facility for service-out installed at a point near the crossing, wherein, when(a vehicle passes by the fixed point information detection support facility for service-in and enters a service area, a driver of the vehicle recognizes availability of the service for provision of information for prevention of bumping after the vehicle stops once in front of a crossing upon reception of a signal indicating start of the service area from the support facility and then restarts, the driver can acquire information concerning vehicles on the priority road when the vehicle once stops in front of the crossing from the on-road infrastructure, and when there is any car entering the crossing on the priority road, said system provides the driver with the information concerning presence of the vehicle.

4. A bumping prevention system for preventing bumping between a vehicle running on a non-priority road and another vehicle running on a priority road at a crossing between the two roads by transacting signals with on-road infrastructure in a service area from a fixed point information detection support facility for service-in installed at a point away by a specified distance from the crossing up to a fixed point information detection support facility for service-out installed at a point near the crossing, wherein, when a vehicle passes by the fixed point information detection support facility for service-in and enters a service, a driver of the vehicle recognizes availability of the service for provision of information, alarms, and controls for prevention of bumping when approaching to a crossing or availability of service for provision of information for prevention of bumping when the vehicle once stops in front the crossing and then restarts, starts computing of a current position of the vehicle by grasping the current running position of the vehicle and a distance up to the priority road, and also wherein said system acquires information concerning vehicles on the priority road from the on-road infrastructure and provides, when there is any vehicle entering the crossing, the driver with the information concerning presence of the crossing and vehicle entering the crossing at a point where the driver can reduce a running velocity of the vehicle with sufficient time allowance for stopping the vehicle in front of the crossing, or gives the driver, when it is determined that there is the possibility of bumping with a vehicle entering the crossing, an alarm concerning the possibility of bumping at a point where the driver brakes the vehicle in an emergency with sufficient time allowance for stopping the vehicle in front of the crossing, continuously provides controls for the decelerating or stopping the vehicle, when it is determined that there is the possibility of bumping with any subsequent vehicle entering the crossing, in a range from a position where the driver can brake the vehicle with sufficient time allowance for stopping the vehicle in front of the crossing to a point in front of the crossing, and further acquired information on vehicles on the priority road from the on-road infrastructure when the vehicle stops in front of the crossing, and provides the information concerning presence of the vehicle when it is determined that there is any vehicle entering the crossing.

5. The bumping prevention system according to claim 4, wherein said system provides a driver of a vehicle with information taking into a period of time in which the driver responds to the information as well as a period of time in which a braking operation is actually effected, gives an alarm to the driver taking into account a period of time in which the driver responds to the alarm and the driver's braking operating is actually effected, and also provides automatic control for stopping the vehicle taking into account a delay time of this control system and a period of time required until braking is actually effected in the emergent stop.

* * * * *